US007568734B2

(12) United States Patent
Hockensmith

(10) Patent No.: US 7,568,734 B2
(45) Date of Patent: Aug. 4, 2009

(54) PERSONAL REGULATOR

(76) Inventor: Richard P. Hockensmith, 1583 Little Egypt Rd., Harrisonville, PA (US) 17228

( * ) Notice: Subject to any disclaimer, the term of this patent is extended or adjusted under 35 U.S.C. 154(b) by 266 days.

(21) Appl. No.: 11/158,193

(22) Filed: Jun. 22, 2005

(65) Prior Publication Data

US 2007/0029776 A1 Feb. 8, 2007

(51) Int. Cl.
*B42D 15/00* (2006.01)
*B42D 3/00* (2006.01)

(52) U.S. Cl. ..... 283/115; 281/29; 283/117

(58) Field of Classification Search ..... 281/15.1, 281/29, 35–38, 40, 45, 46, 48, 49, 51; 283/63.1, 283/2–4, 34, 44, 61, 62, 115, 117
See application file for complete search history.

(56) References Cited

U.S. PATENT DOCUMENTS 534,726 A * 2/1895 Stevens ..... 40/119
2,354,589 A * 7/1944 Georgi ..... 281/43
2,795,059 A * 6/1957 Mendelsohn ..... 434/75
3,096,102 A * 7/1963 Wiands et al. ..... 281/33
4,216,979 A * 8/1980 Janik ..... 283/58
4,534,581 A * 8/1985 Engh ..... 281/15.1
4,717,176 A * 1/1988 Matthews ..... 281/15.1
5,029,902 A * 7/1991 Komori ..... 283/56
5,104,146 A * 4/1992 Schulz et al. ..... 281/15.1
5,238,345 A * 8/1993 D'Andrea ..... 412/4
5,636,872 A * 6/1997 Gamer et al. ..... 283/49
5,655,866 A * 8/1997 Bellanca ..... 412/1

* cited by examiner

*Primary Examiner*—Dana Ross
*Assistant Examiner*—Pradeep C Battula
(74) *Attorney, Agent, or Firm*—Dwight G. Diehl

(57) ABSTRACT

A personal regulator or device having special covers and a plurality of interior panels or pages containing various hinged structures. The hinging structures are precision expandable hinges which permit portions of consecutive panels to be functionally interactive and viewed simultaneously and/or to permit viewing of different portions of interior panels while viewing two charts attached to the device enclosures. The precision expandable hinging structures provide and allow for a plurality of charts to be viewed simultaneously and accurately registered with each other without the need of repeatedly turning between pages or panels.

6 Claims, 2 Drawing Sheets

PERSONAL REGULATOR

BACKGROUND OF THE INVENTION

The present invention is very closely related to prior U.S. patent application Ser. No. 10/189,829 entitled Guide With Combined Displays of Multiple Data, filed Jul. 8, 2002 and assigned to Art Unit 3722, now abandoned.

This invention relates to a personal regulator or device and in the preferred embodiment to an exercise and nutritional device having separate panels in a hinged arrangement for displaying various charts for foods, food values, intake levels and exercise, exercise values and calories burned for display of consecutive days.

The use of printed materials and/or books to monitor and record data is well known in the art. In a typical nutritional booklet, pages are hinged together at the center to form a booklet, each page containing a chart, normally for one day, to allow the user to journal their intake quantities of particular food items as well as the nutritional or caloric values thereof. A user typically relies on the book for determining and journaling each food item consumed during a day and relies on charts and tables to determine the caloric or calorie values of that food item. In order to provide such nutritional values for each food item consumed, an amount of flipping between the particular page and the chart containing the food items is required. A user would need to refer to a nutritional chart to obtain the nutritional values associated with that food, then flip back to the page for the particular day in which the item is being journaled and record those nutritional values. The repetitive and inconvenient turning of pages or referring to a second chart is necessitated by the fact that one cannot simutaneously view the chart and the recording page at the same time.

While it is possible to have a chart separate from the nutritional booklet so that one can be viewing the chart and at the same time completing the daily entries, this would require the booklet as well as a separate chart. Thus to carry the chart and the booklet with one while dining out or on a trip would be burdensome and inconvenient to accurately maintain one's nutritional records. There is thus a need in the prior art for a multi panel nutritional booklet or device providing a simultaneous display and view of food items, the nutritional values of said food items, and the daily logging panel necessary to log the food consumed by the user. Also, exercises, calories burned and daily log of exercise to assist in self improvement in health wellness can be monitored and logged.

SUMMARY AND OBJECTS OF THE INVENTION

It is accordingly an object of the present invention to overcome the difficulties of the prior art and to provide a personal regulator device structured for simutaneous display of three columns or charts on panels at the same time. It is a more specific object of the invention to provide a multi panel, multi chart, nutritional and exercise device wherein the user can view a chart listing food and exercise items; nutritional values for said food items; calories burned per exercise; a chart for the individual to log the food items consumed; nutritional values associated with those items; exercises and values associated and a log of calories burned, without the necessity of referring to separate charts or turning pages to view these items. It is a further object of the invention to provide a simple structure enabling the user to view an entire day of foods, intakes, nutritional values, exercises, calories used and values of exercise by simply folding a panel in half without the necessity of referring to a chart or multiple pages at one time. In accordance with these and other objects of the invention there is thus provided a means for simutaneously exposing a chart having food items thereon, an intake chart, and nutritional values of the foods and exercises thereon, a calories burned chart and exercise values simultaneously and the intake page being hinged in the middle to allow for the viewing of a second food chart, intake chart, and nutritional values chart. Preferably, the present invention is a device having multiple panels hinged together at the center and allowing for multiple panels to be viewed at one time.

BRIEF DESCRIPTION OF THE DRAWINGS

A brief description of the drawings is as follows.

DETAILED DESCRIPTION

Figure 1:
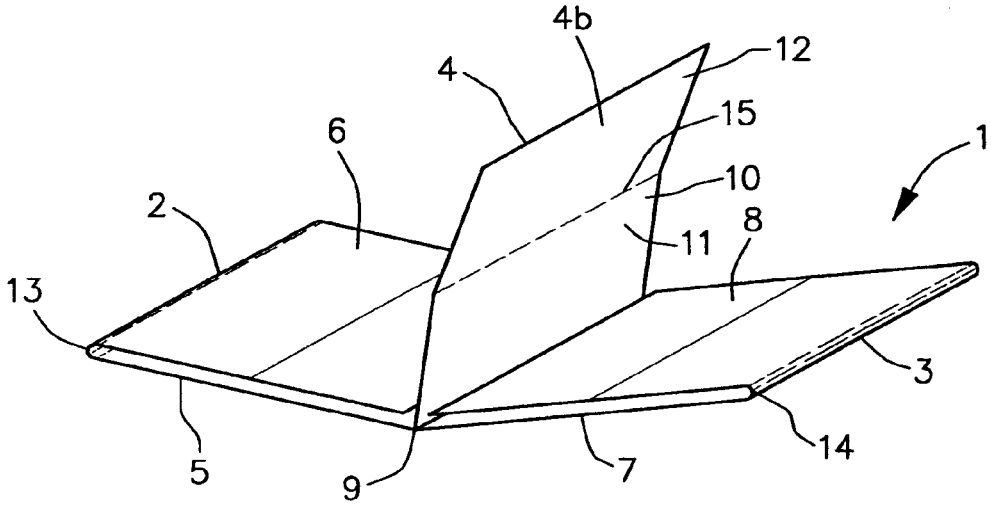
FIG. 1 is a front view of the personal regulator or device showing the front enclosure with precision expandable hinges, back enclosure with precision expandable hinge, and reversible hinges.

The personal regulator or device of the present invention is a nutritional device 1, (exercise device operates simultaneously with nutrition, thus is not separately described) comprised primarily of a front enclosure means 2, a back enclosure means 3, center or interior intake panels 4 having a front side 4*a* and a back side 4*b*, nutritional operations charts 6, 8, and 10; and a plurality of hinges or hinge means 9, 13, 14, and 15. The front enclosure means 2 is hinged approximately in the middle and is of a width twice that of the interior panel 4. The back enclosure means 3, which is hinged to with the front enclosure means 2 is further hinged approximately in the middle and of a width twice that of the interior panels 4 and equal to the width of the front enclosure means 2. The front enclosure means 2 contains a front cover 5 and a nutritional chart 6 and the back enclosure means 3 contains a back cover 7 and a display or nutritional chart 8. The charts 6 and 8 are smaller than the covers 5 and 7 to allow for a small amount of floating. The floating is necessary because as more panels 4 are used the hinge 13 will need to expand to allow the front cover means 2 to accept additional pages. At the same time the hinge 14 of the back cover means will be contracting as the number of panels 4 enclosed in back cover means 3 decreases. The charts 6 and 8 move or float a small distance right to left to allow alignment to continue.

The precision expandable hinges 13 and 14 are made with the use of a knife that has a thickness equal to the thickness of the number of panels 4 to be utilized in the booklet. The thickness of the knife and expansion of the hinges can be varied as needed to allow the booklet to accept the desired number of panels 4. While the hinges 13 and 14 allow the charts 6 and 8 to float a small distance right to left, left to right, they are referred to as precision hinges because they do not allow vertical movement of the charts 6 and 8, thus keeping the charts precisely aligned.

Each of the interior intake panels 4 is hinged in the center thereof making them ¼ the width of the front and back enclosure means 2 and 3 when folded at the reversible hinge 15. Each of the interior intake panels 4 contains an intake chart 10 on each side 4*a*, 4*b* of the panel. On each side of the panel the intake chart 10 is comprised of two columns labeled A and B, thus each side of the interior panels 4 contains one A column 11 and one B column 12 chart for intake values. The nutritional chart 6 is a food chart which contains the list of foods that one would consume during a day. The chart 6 contains, but is not limited to, such foods as milk and yogurt, saturated and unsaturated fats, fruits and vegetables, meats, cheeses, eggs, breads, and starches. Each of these items lists a specific food and amount to be consumed which will correspond with values on the nutritional chart 8, which is a value chart. The value chart 8 has columns and entries that match the columns and entries on the foods chart 6, namely, the milk and yogurt, saturated and unsaturated fats, fruits and vegetables, meat, cheese, eggs, breads, and starches. The calorie, fat and cholesterol and carbohydrate values listed on these charts correspond to the quantities as listed on the foods charts.

The front enclosure means 2, when opened to its maximum width contains the identification of the device and the front cover 5 to the left of a front precision expandable hinge 13, said hinge 13 being in the middle of the enclosure means 2. To the right of the front hinge 13 is chart 6 containing two columns, the left hand column titled foods A and the right hand column titled foods B. These two columns constitute the foods chart 6. When the front enclosure means 2 is closed at hinge 13 the front cover 5 remains to the outside of the device 1 and the foods chart 6 is hinged to the inside of the device to enclose one or more of the interior panels 4.

The back enclosure means 3 is of similar construction and when opened to its maximum width, to the right hand side of a back enclosure precision expandable hinge 14, which is in the center of the back enclosure means 3, is the exterior protective back cover 7 of the device with identifying information contained thereon. To the left of the precision expandable hinge 14 are two columns titled values A, to the far left, and values B, to the immediate left of the hinge 14. These two columns form the values chart 8 which contains the nutritional values that corresponds to the food quantities contained on the foods chart 6. When this back enclosure means 3 is hinged the back cover 7 remains on the outside of the device 1 while the values chart 8 is hinged to the interior and encloses one or more of the interior panels 4.

Figure 2:
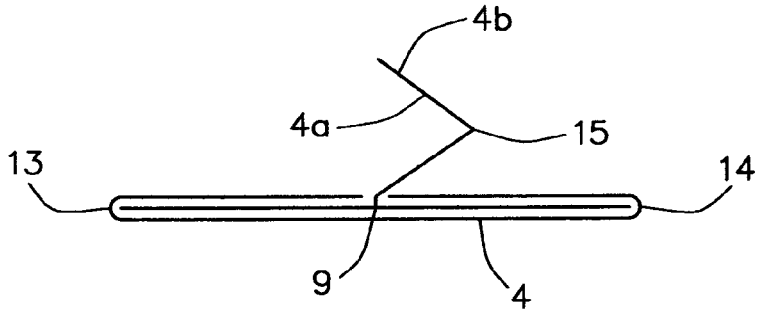
FIG. 2 is a side view showing an interior panel being hinged to the left for next days use.
Figure 3:
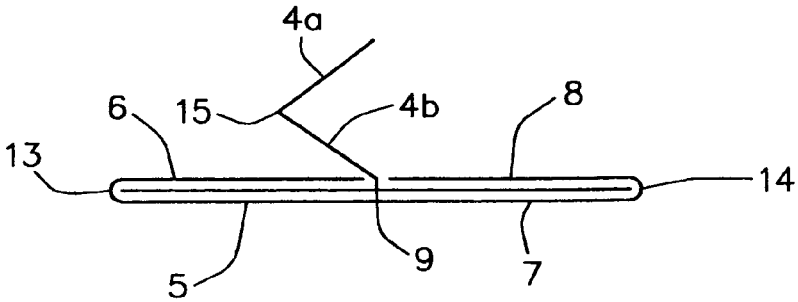
FIG. 3 is a side view showing the center panel being folded or hinged to the right for earlier days use.

The interior panels 4 are hingedly attached to the center hinge 9 that connects the front enclosure means 2 to the back enclosure means 3. Numerous interior panels 4 are then contained between the front and back cover 5 and 7. Each interior panel 4 is a two-sided panel having two intake columns on each side 4*a*, 4*b*. Each side of the panel contains one intake B column 12 and one intake A column 11. When opening the front enclosure 2 and looking at the front 4*a* of an interior panel 4, the column to the left is intake B 12 and the column to the right is intake A 11. Upon turning the panel to view the back 4*b* of the interior panel 4, like columns are contained thereon, with intake column B 12 on the left and intake column A 11 on the right. A reversible panel hinge 15 in the center of each interior panel 4 divides the intake column B 12 from the intake column A 11. This reversible hinge 15 allows for each interior panel to be folded in half and expose either intake column B 12 or intake column A 11 at the user's preference. When an interior panel is folded at the panel hinge 15 from right to left, or back to front as shown in FIG. 2, intake column B 12 on the back side 4*b* will be first visible. Keeping the panel folded as such and folding the panel 4 toward the front enclosure means 2, one can view the column intake A 11 on the back 4*b* of the interior panel 4. If the interior panel is folded left to right as shown in FIG. 3 exposing the front of the interior panel 4, initially intake column A 11 will be visible. Again, hinging or moving the panel at the center hinge 9 that connects the front enclosure means 2 and the back enclosure means 3, column intake B 12 on the front 4*a* of the interior panel 4 becomes visible.

The use or operation of the present invention will now be described. One would open the device 1 and unfold the front enclosure means 2 and utilize the foods chart 6 to cover the front panels to the interior of the device, having an unused interior panel 4 showing intake columns to the right thereof Next, the user would open the back enclosure means 3 and then hinge the values chart 8 to the interior of the device 1 covering all of the unused interior panels 4 except the one exposed immediately adjacent to those covered by the food chart 6. This then allows a user to have one interior panel 4 visible between the front and rear enclosures 2 and 3 and specifically between the food chart 6 and the value chart 8. Then, for purposes of illustration, it would be assumed that none of the intake columns have been utilized. The user would then fold, at the reversible hinge 15, the interior panel 4 from left to right (FIG. 3) and hinge the panel 4 at the center hinge 9 between the front and back enclosures 2 and 3 to the left. By doing this, one would have visible to them, the foods A column on the foods chart 6 to the far left of the booklet, immediately adjacent thereto would be an unused intake A column 11, and immediately to the right of that contained on the values chart would be the values A column of the values chart 8. Thus one could readily log on the intake A column 11 what foods they consumed and in what quantities. Then, by comparing the quantity consumed to the quantities on the foods A column with the values on the value A column, the user could complete the nutritional value of the foods consumed, thus allowing one to complete a nutritional chart without the need of flipping pages or referring to a separate chart. If the foods the individual consumed are not contained on the foods A column, one would then simply fold the interior panel at the center hinge 9 connecting the front and back enclosure means 2 and 3 to the right thus exposing the B columns 12. With the booklet in this position, to the far right would be the values B column, immediately to the left thereof would be the intake B column 12 and immediately adjacent to the left of the intake B column 12 would be the foods B column. This would then allow the user to again record the quantity of the foods consumed, compare that with the quantities listed in the foods B column and record the nutritional values of the foods consumed. Once one panel is completed for one day, the next day the user would simply reverse hinge the interior panel 4 at the page hinge 15, right to left (FIG. 2), exposing new unused intake A and intake B columns 11 and 12. Then, depending on whether the folded interior panel 4 is hinged to the left or the right at the center hinge 9 connecting the front and back cover, one would expose and align intake column A 11 or B 12 with the appropriate foods column and the values column. After completing a second day and filling this side of this interior panel, on the next day one would simply open the back enclosure and remove an interior panel from under the values chart and place the completed panel under nutritional chart 6 and again proceed to record the next days food consumption on the interior panel 4 which has been folded in half at the panel hinge exposing new intake columns A and B, 11 and 12.

The back and front enclosure hinges 13 and 14 are special precision expandable hinges to assure error free row alignments of front panel food chart 6, back panel values chart 8 and interior intake panels 10 as they are used to log daily intakes.

This invention allows one to monitor and record their intake quantity of food and to easily and readily calculate the nutritional values associated with those foods and quantities without referring to separate charts or switching between a chart on a separate page and the intake chart. The size of the present invention preferred embodiment, also enables one to readily take the nutritional device with them when they go out for meals or are away from home for an extended period of time such as on work assignments or vacations. The interior of the device contains numerous interior panels and can be numbered such that the intake panels would be sufficient to cover a one month period of time in the preferred embodiment, however, the device could contain less than a one month time frame or more than a one month time frame as desired by the user. Also inside the device 1 in addition to the intake panels 4 or columns 11 and 12, are included to the front and rear of the panels 4, an introduction, instructions of use, how it works, tips and other nutritional information, as well as samples or examples of how to use the nutritional device. Additionally, after the interior panel 4, could be included an orientation and familiarization of nutrition simplified guide, a chart of weight and volume conversions, as well as, a monthly or yearly calendar, or any other information that one might deem useful to an individual possessing the nutritional device. The examples given regarding what other information or pages can be contained within the device, as well as the number of intake charts, are merely illustrational and not all of that information needs to be included, or more charts or information could be included without deviating from the novel concept of this invention.

Figure 6:
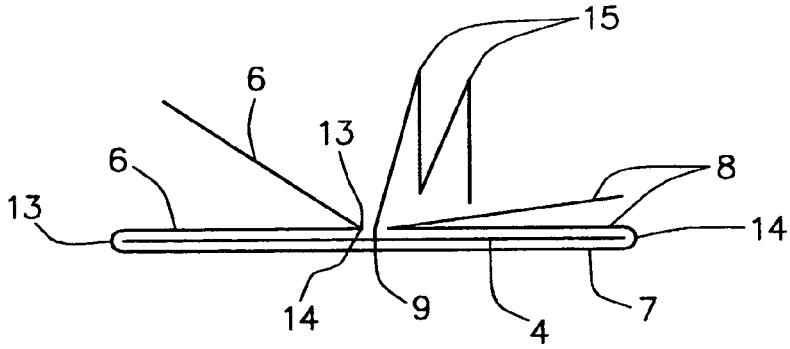
FIG. 6 is an alternative design showing 1 reversible hinge and 1 expandable hinge on the front enclosure, 1 reversible hinge and 1 expandable hinge on the rear enclosure, and a plurality of reversible hinges on the interior panel.

The preferred embodiment of the present invention could be expanded to include additional charts and/or columns. This can be accomplished by adding one or more reversible hinges 15 to the right side of the chart 6 and add one or more charts as shown in FIG. 6 and by adding the corresponding number reversible hinges 15 and charts to left of chart 8. Additional columns or charts would also be added to the interior panels 4 by adding one or more reversible hinges 15.

Figure 4:
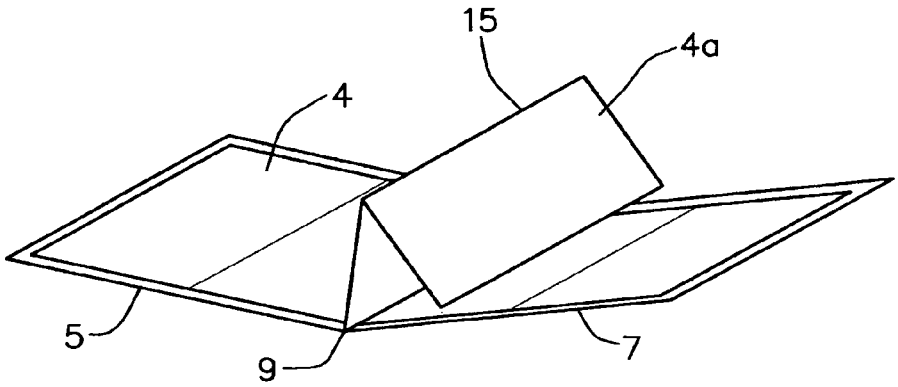
FIG. 4 is a view of an alternative design showing the center panel being hinged to the right with only 2 center panels.
Figure 5:
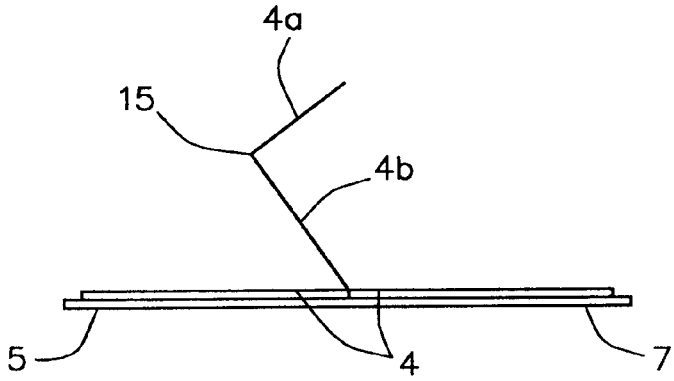
FIG. 5 is a side view of the alternative design as shown as shown in FIG. 4.

An alternative design, shown in FIGS. 4 and 5, would be to have the front enclosure means 2 and the back enclosure means 3 consist of only the front cover 5 and back cover 7 and panels 6 and 8 containing applications, charts, and data of frequent usage. The interior panels 4 would contain periods of time, such as a day, one-half week or an entire week, on the front side 4*a* thereof The operation of the present invention as a calendar device is as follows. The interior panels 4, for purposes of illustration, contain two weeks on the front side 4*a* thereof. Using the month of June as an example, the column 10 on the right side of the panel hinge 15 is the second week of June and the column 12 on the left side of the panel hinge 15 is the first week of June. On the front of the next consecutive interior panel 4 the third and fourth weeks of June would be displayed, with the third week on the left of the panel hinge 15 and the fourth week on the right of the panel hinge 15, as viewed in FIG. 5.

To view the first two weeks of June one simply looks at the front of the interior panel 4 containing said weeks as the first week passes and one wants to view the upcoming weeks the interior panel 4 is folded at the reversible panel hinge 15 left to right while the interior panel is hinged to the left at hinge 9. This now allows one to view the second, third and fourth weeks of June at the same time. As June passes and July approaches one would fold the interior panel containing the third and fourth weeks of June at the panel hinge 15, left to right, and the interior panel 4 to the left at the center hinge 9, allowing one to view the fourth week of June and the first two weeks of July displayed on the next interior panel 4, simultaneously.

Panel 4*b* has two columns for recording additional daily timed notes. As panel becomes the past time, it is reversed hinged at 15 for taking notes in column 10 related to adjacent week in column 12. It is then unhinged 15 for recording notes of column 10 as panel 4*a* is hinged 9. Contiguous time and notes result.

As is evident to one of ordinary skill in the art, the interior pages 4 could contain days or partial weeks or other calendar periods in place of whole weeks without departing from the inventive concept of the present invention.

I claim:

1. A personal regulator device comprising:

a front enclosure means containing at least one precision expandable hinge means, a front cover and a chart comprising at least two columns therein with the front cover and the chart connected with said precision expandable hinge means;

a back closure means containing at least one precision expandable hinge means, a back cover, and a chart comprising at least two columns, with the back cover and the chart connected by said precision expandable hinge means;

a plurality of interior pages, each page containing at least one reversible hinge means;

a center hinge means interconnecting front enclosure means, back enclosure means, and said interior pages; wherein each interior page contains at least two columns on the front side and the back side of each page, with one column on each side of the page being located on opposite sides of the reversible hinge means;

the precision expandable hinge means provides precise alignment of at least one column on each of the cover means with at least one column on an interior page;

the precision expandable hinge means and reversible hinge means provide for precise alignment such that when an interior page is hinged right at the reversible hinge means and left at the center hinge means, the right column on the front of said interior page aligns with the left column on the front cover means and simultaneously aligns with the left column on the back cover means;

the precision expandable hinge means and the reversible hinge means provide for precise alignment such that when an interior page is hinged right at the reversible hinge means and right at the center hinge means, the left column on the front of said interior page aligns with the right column on the front cover means and simultaneously aligns with the right column on the back cover means;

the precision expandable hinge means and the reversible hinge means provide for precise alignment such that when an interior page is hinged left at the reversible hinge means and left at the center hinge means, the right column on the back of said interior page aligns with the left column on the front cover means and simultaneously aligns with the left column on the back cover means; and the precision expandable hinge means and the reversible hinge means provide for precise alignment such that when an interior page is hinged left at the reversible hinge means and right at the center hinge means, the left column on the back of said interior page aligns with the right column on the front cover means and simultaneously aligns with the right column on the back cover means.

2. A device as recited in claim 1 and further comprising:

said front enclosure means has a width two times a width of the interior pages.

3. A device as recited in claim 1, and further comprising:

said portion of interior panels have at least two reversible hinges therein;

said front enclosure means includes a front cover and two nutritional charts and one reversible hinge; and said back enclosure means includes a back cover and two nutritional charts and one reversible hinge.

4. A device as recited in claim 1, and further comprising:

said front enclosure means is comprised of a front cover, a precision expandable hinge and time charts;

said back enclosure means is comprised of a back cover, a precision expandable hinge and time charts;

said plurality of interior panels each contain a plurality of time periods on one side thereof and time period related notes on the opposite side, with a reversible hinge.

5. A device as recited in claim 4, and further comprising:

said plurality of time periods contained on the portion of interior panels are each separated by reversible hinge means.

6. A device as recited in claim 1 and further comprising:

said charts contained on said front enclosure means are nutritional charts.

* * * * *